United States Patent [19]

Bowers

[11] 4,262,384

[45] Apr. 21, 1981

[54] VACUUM CLEANER BAG ASSEMBLY

[75] Inventor: William D. Bowers, Avon, Ohio

[73] Assignee: The Scott & Fetzer Company, Lakewood, Ohio

[21] Appl. No.: 115,349

[22] Filed: Jan. 25, 1980

[51] Int. Cl.[3] ..... A47L 5/28

[52] U.S. Cl. ..... 15/328; 15/351; 55/375; 55/378; 55/380; 55/DIG. 2

[58] Field of Search ..... 15/328, 350, 351; 55/367, 374, 375, 378, 380, DIG. 2

[56] References Cited

U.S. PATENT DOCUMENTS

| | | | |
|---|---|---|---|
| 2,122,568 | 7/1938 | Gasner et al. | 55/375 X |
| 3,032,799 | 5/1962 | Smith | 15/350 X |
| 3,634,905 | 1/1972 | Boyd | 15/350 |
| 3,971,643 | 3/1975 | Hufton | 55/380 X |
| 4,119,414 | 10/1978 | Smaling | 55/380 X |

FOREIGN PATENT DOCUMENTS

| | | | |
|---|---|---|---|
| 973472 | 10/1964 | United Kingdom | 15/351 |

*Primary Examiner*—Christopher K. Moore
*Attorney, Agent, or Firm*—Pearne, Gordon, Sessions, McCoy & Granger

[57] ABSTRACT

There is disclosed a vacuum cleaner bag assembly for an upright vacuum cleaner comprising a flexible, air-permeable, outer bag having an upper end adapted to be attached to a handle of a vacuum cleaner. The other end of the outer bag has an open mouth attached to an open mouth of a dirt-collecting box. The dirt-collecting box has a suction inlet opening and also a suction outlet opening which comprises its open mouth. A tube closes the open mouth of the box and is in fluid communication with the box and extends toward the top of the outer bag. A disposable inner bag is provided within the outer bag and has an inlet opening in fluid communication with the tube. A vacuum cleaner provided with the bag assembly may be operated as a vacuum cleaner with a disposable bag with all of the foregoing elements in place, or as an air-permeable outer bag filter vacuum when the tube and disposable bag are removed.

8 Claims, 6 Drawing Figures

FIG. 3
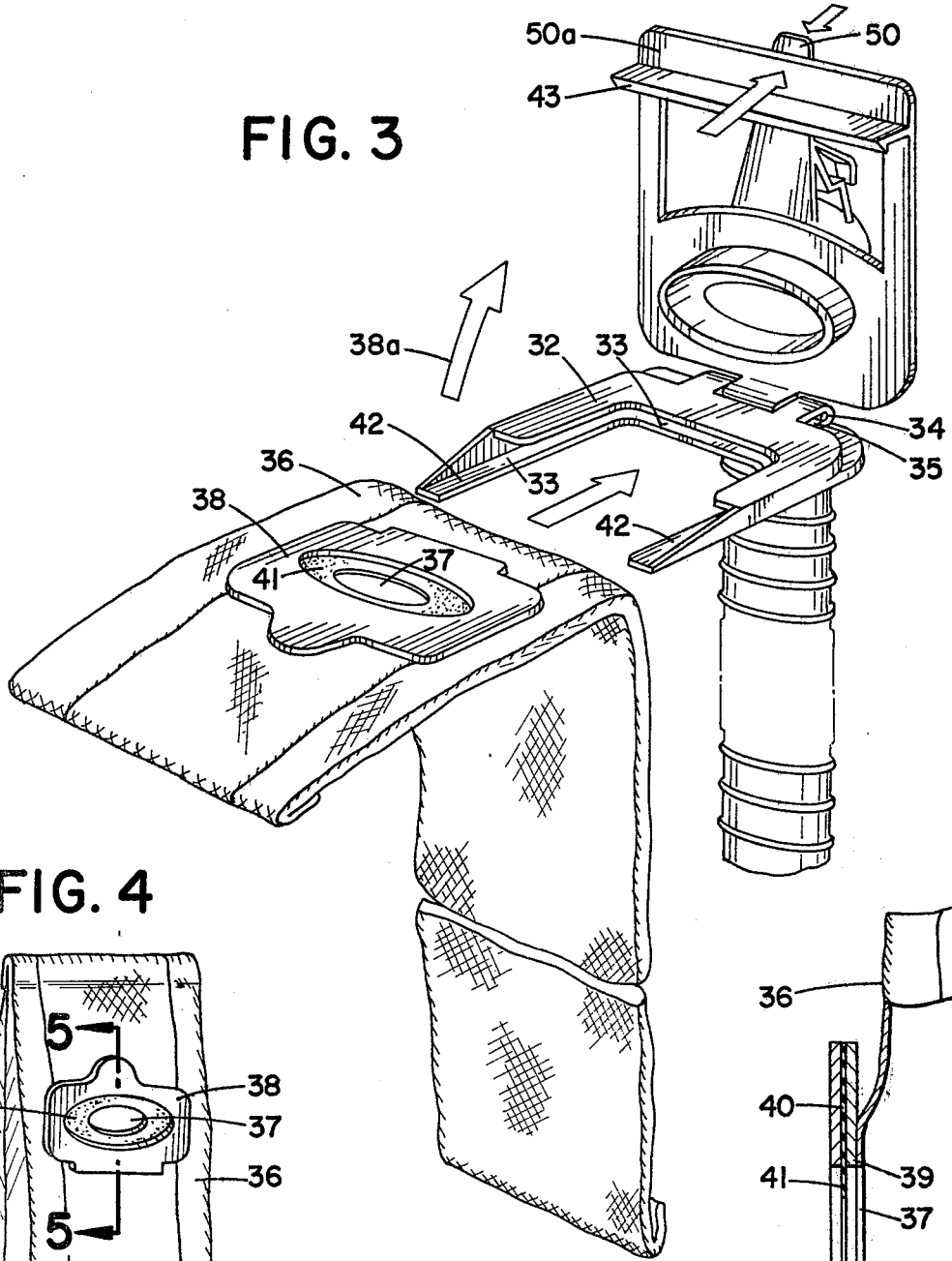
FIG. 4
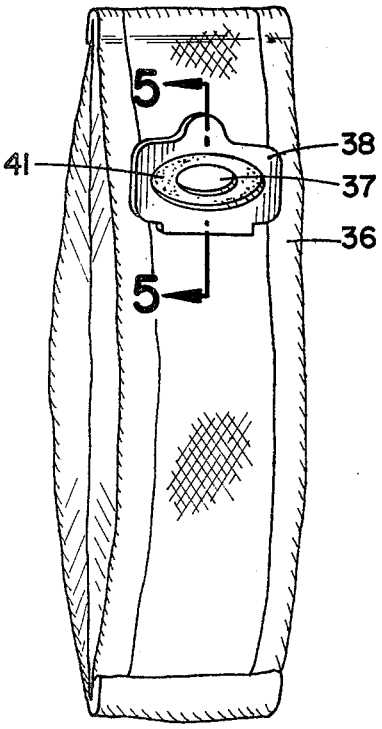
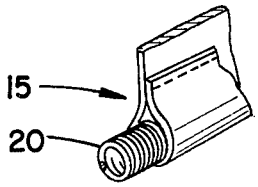
FIG. 6
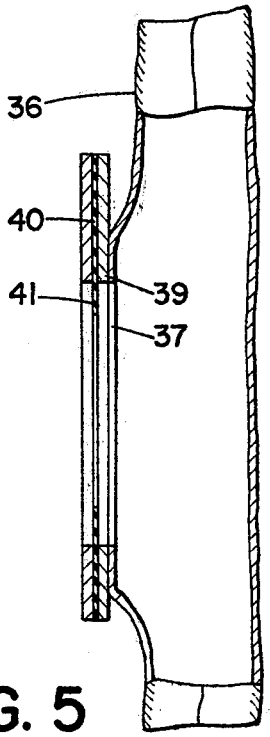
FIG. 5

VACUUM CLEANER BAG ASSEMBLY

BACKGROUNF OF THE INVENTION

This invention relates to bag assemblies for upright vacuum cleaners, and more particulary, to an arragnement which will permit the cleaner to be operated either as a cleaner having a disposable bag or a cleaner having a cloth bag with a box for collecting dirt.

Basically, there are three types of powered upright vacuum cleaners in use today. A first type is an upright vacuum cleaner having a soft, flexible, dirt-catching bag which has a weave such that air is permitted to pass through the bag while the dirt remains trapped inside. The dirt is later removed manually to a bag or other receptacle for disposal. A second type of upright vacuum cleaner is a vacuum cleaner having an outer bag and an encased disposable inner bag attached to a blower outlet. The outer bag is generally fabricatd from a flexible vinyl that has a number of perforations therethrough to permit the free passage of air from the disposable bag. One technique for connecting the bag to the blower outlet is to flip the end of the bag over a tube leading from the blower outlet and then roll a rubber sleeve onto the neck of the bag to firmly hold the bag in place. A third type upright vacuum cleaner is a hard box upright which has a sealed upright box containing a disposable bag. The hard box upright vacuum cleaner is essentially a canister-type cleaner in that the disposable bag is upstream of the vacuum cleaner fan so that dirt is sucked into the bag, rather than being propelled therein by the fan.

There are a number of disadvantages to each of these vacuum cleaners. As to the cleaner having the flexible air-permeable bag, one such disadvantage is that it is a messy operation to empty the bag or a dirt box onto newspaper or a disposable bag. The problem is particularly acute where the person emptying the dirt box or bag is allergic. While a vacuum cleaner having a disposable bag is convenient, it is difficult to connect the bag to the short tube running to the rug-cleaning nozzle. Moreover, the elastic sleeve which holds the bag onto the tube tends to tear during use. The short tube frequently becomes clogged and must be cleaned.

SUMMARY OF THE INVENTION

This invention provides a vacuum cleaner which may be converted from a disposable bag cleaner to a cleaner having a flexible air-permeable bag so that the user may determine whether or not a disposable bag should be used. Moreover, a person may temporarily run out of disposable bags, but will still be able to use the vacuum cleaner.

The vacuum cleaner according to this invention includes a flexible air-permeable outer bag having an upper end which is adapted to be attached to the handle of an upright vacuum cleaner. The other end of the outer bag has an open mouth which is attached to an open mouth of a dirt-collecting box. The dirt-collecting box has a suction inlet and a suction outlet to which the outer bag is attached. There is provided a partition across the open mouth of the box and a tube extends from the partition toward the top of the outer bag. A disposable inner bag is provided within the outer bag and has an inlet opening in fluid communication with the tube. The inner bag is attached to the tube by a coupling member which comprises a first flat plate surrounding and extending from a location adjacent the end of the tube. There is provided a second channeled flat plate hinged to the first flat plate which has a U-shaped channel therein extending from one edge thereof. The inside bag has a collar extending from its inlet opening. The collar slips into a guide slot provided along the edges of the second plate and the neck of the bag extends through the U-shaped opening with the end of the tube projecting into the inlet opening of the bag. The plates are then locked together to securely hold the inside disposable bag.

BRIEF DESCRIPTION OF THE DRAWINGS

FIG. 3 is a perspective view of a disposable bag being mounted in place;

FIG. 4 is a perspective view of the disposable bag;

FIG. 5 is a cross sectional view, the plane of the section being indicated by the line 5—5 in FIG. 4; and FIG. 6 is a fragmentary, perspective view of a portion of the cloth bag.

DETAILED DESCRIPTION OF THE INVENTION

Figure 1:
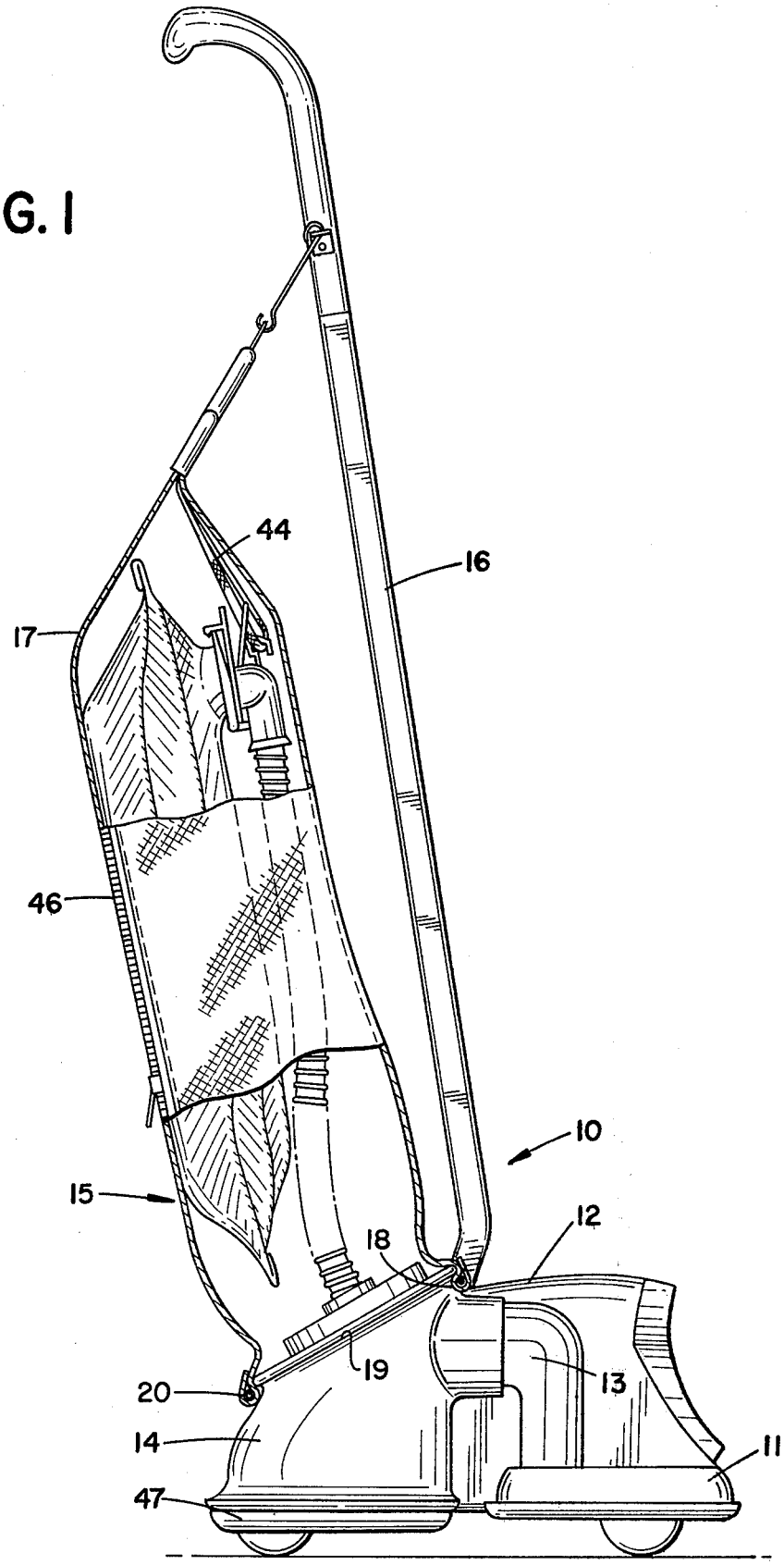
FIG. 1 is a side elevational view of a vacuum cleaner, partly in section, illustrating the bag arrangement according to this invention.

Referring now to the drawings, and particularly FIG. 1, there is illustrated a vacuum cleaner 10 which is employed for on-the-floor cleaning operations. The vacuum cleaner 10 generally includes a rug-cleaning nozzle 11, a motor housing 12, an exhaust fan outlet nozzle 13, a dirt-collecting box 14, a bag assembly 15, and a handle 16. As is conventional in such vacuum cleaners, a vacuum cleaner fan (not shown) sucks dirt into the cleaner through the rug-cleaning nozzle and then blows the dirt-laden air through the tube 13 to some arragement for separating and collecting the dirt from the air.

In this particular arrangement, the bag assembly 15 may be used with or without a disposable bag. The bag assembly 15 includes a cloth outer bag 17 having an open lower mouth 18 which is securely but removably held to an open upper mouth 19 of the dirt box 14 by a surrounding internally sewn spring 20.

Figure 2:
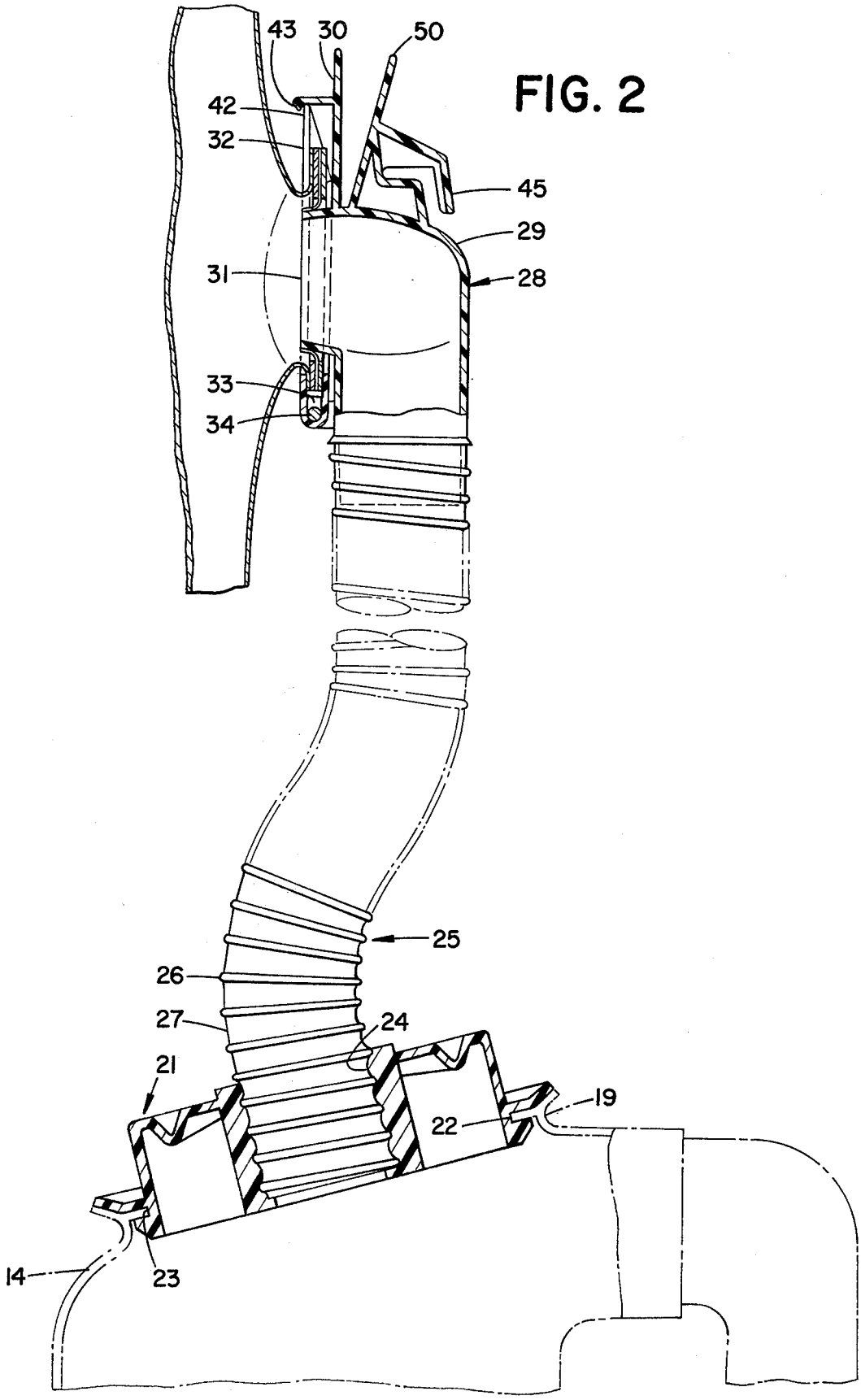
FIG. 2 is an elevational view of the bag mounting member, partly in section.

As may be seen most clearly in FIG. 2, a removable cap 21 is snapped into the open mouth 19 of the dirt box so that an annular projection 22 extends into an annular groove 23 in the cap 21. The cap 21 has an aperture 24 therethrough which receives one end of a dirt-conveying tube 25. The tube 25 consists of the coiled wire 26 covered by a clear plastic material 27. It is preferable that the plastic material 27 be clear or transparent so that one may inspect the tube for any possible dirt blockages. A molded connector assembly 28 is provided at the upper end of the hose 25 and comprises an elbow 29 having a first flat plate 30 surrounding and extending from a location adjacent the end or open mouth 31 of the elbow. A second flat plate 32 is hinged to the first flat plate and has a U-shaped opening 33 therein which extends inwardly from one edge toward a hinger 34. A U-shaped hinge channel 35 is formed in the second plate 32.

There is provided a disposable inner bag 36 which may be formed from a conventional filter material, such as porous paper. The bag 36 has an opening 37 which is surrounded by a stiff collar 38. The collar 38 is attached to the bag 36 adjacent its inner peripheral edge 39 so that there exists a space between the collar 38 and the bag 36. The collar 38 is a laminate having an inner layer 40 of rubber, or the like. The layer 40 projects radially inwardly past the collar to provide an annular lip 41 surrounding the opening 37. The bag is assembled onto the coupling by inserting the collar 38 into the U-shaped channel 33 and then moving the second plate in the direction of the arrow 38*a* in FIG. 3 so that ends 42 of the plate 32 snap under a lip 43 provided in the first plate 30. As the second plate snaps into place, the open mouth 31 of the connector 28 enters the opening 37 in the bag and that connection is sealed by the annular lip 41. The disposable bag may be removed by squeezing an extending tab 50 toward a tab 50*a*. This action effectively frees the ends 43. The inner bag assembly is suspended from the top of the outer bag 17 by a strap 44 which engages a hook 45 provided on the coupling 28. To provide access to the disposable bag, a zipper 46 is provided in the outer bag.

To employ the vacuum cleaner 10 as a nondisposable cloth bag vacuum, the inner bag assembly is removed, including the partition 21, so that the dirt box 14 is employed to collect dirt from the outer bag 17. The dirt box may be emptied by removing the bottom plate 47 which is retained on the dirt box by latches (not shown).

Although the preferred embodiment of this invention has been shown and described, it should be understood that various modifications and rearrangements of the parts may be resorted to without departing from the scope of the invention as disclosed and claimed herein.

What is claimed is:

1. A vacuum cleaner bag assembly for an upright vacuum cleaner comprising a flexible air-permeable outer bag having an upper end adapted to be attached to a handle of a vacuum cleaner, the other end of said outer bag having an open mouth attacheed to an open mouth of a dirt-collecting box, a suction inlet opening in said dirt-collecting box, said open mouth of said box comprising a suction outlet opening from said box, tube means closing said open mouth of said box and in fluid communication with said box and extending toward the top of said outer bag, a disposable inner bag within said outer bag having an inlet opening in fluid communication with said tube means, whereby a vacuum cleaner provided with such an assembly may be operated as a vacuum cleaner with a disposable bag with all of the foregoing elements in place, or as an air-permeable outer bag filter vacuum when the tube means and disposable bag are removed.

2. A vacuum cleaner bag assembly according to claim 1, including coupling means to place the inlet of the disposable inner bag in fluid communication with said tube means, said coupling means comprising a first flat plate surrounding and extending from a location adjacent the end of the tube, a second flat plate hinged to said first flat plate, said second plate having a U-shaped opening therein extending from one edge thereof, said inner bag having a collar extending from its inlet opening, attaching means to attach said colar to one of said plates so that a neck of the bag extends through said U-shaped opening with the end of said tube projecting into the inlet opening of the bag, and means to lock said plates together.

3. A vacuum cleaner bag assembly according to claim 2, wherein said attaching means comprises guide slot means along the edges of said second plate.

4. A vacuum cleaner bag assembly according to claim 3, including means to attach said tube to the top of the outer bag.

5. A vacuum cleaner bag assembly according to claim 4, wherein said outer bag is cloth and said inner bag is paper.

6. A vacuum cleaner bag assembly according to claim 2, wherein said means to lock said plates together comprises a notched lip on one of said plates which interlocks with a lip on the other plate.

7. A vacuum cleaner bag assembly according to claim 2, wherein the connector forms a 90° angle with respect to said tube.

8. A vacuum cleaner bag assembly according to claim 7, wherein the inlet opening of said inner bag is provided with an elastic membrane which grips the end of said connector.

* * * * *